United States Patent [19]

Carson

[11] 4,000,569

[45] Jan. 4, 1977

[54] IRONING TABLE

[76] Inventor: Monte A. Carson, 18144 Cherry, Hisperia, Calif. 92345

[22] Filed: May 27, 1975

[21] Appl. No.: 581,286

[52] U.S. Cl. ..... 38/135; 223/72

[51] Int. Cl.[2] ..... D06F 81/00

[58] Field of Search ..... 38/1 B, 3, 4, 6, 135, 38/16, 17, 15, 69, 99, 70, 137, 71, 136, 72, 138, 141, 144; 223/66, 69, 2, 52, 52.1, 61, 72, 73, 57; 68/240

[56] References Cited

UNITED STATES PATENTS

| | | | |
|---|---|---|---|
| 2,807,106 | 9/1957 | Kary | 38/135 |
| 3,229,393 | 1/1966 | Kroenke | 38/141 X |
| 3,653,135 | 4/1972 | Jones | 38/135 |

*Primary Examiner*—G. V. Larkin

*Attorney, Agent, or Firm*—Fulwider, Patton, Rieber, Lee & Utecht

[57] ABSTRACT

There is disclosed an ironing table that is uniquely suited for use by tailors, particularly for use by homemakers who have need for a compact ironing table having a plurality of iron-working surfaces which are suited for particular purposes. The table comprises a base formed with a platform and an upright standard thereon having a substantially flat planar upper surface and an outboard edge surface and a plurality of interchangeable elongated members bearing iron-working surfaces of different sizes and shapes. The elongated members are removably attached to the base with first clamping means comprising dowel means carried on the upper end of the outboard edge surface of the upright standard with cooperating eyelet means carried at one end and on the undersurface of the elongated members. The second clamping means comprises key means carried at the inboard end of the upright standard with cooperative keyway means carried at an intermediate position on the undersurface of the elongated member. These clamping means secure the elongated members to the base and prevent any lateral or longitudinal shifting and any tilting of the elongated members. The elongated members are supplied as a set of interchangeable members to provide an ironing table having small and large sleeve boards, a seam board, a point board and a half circle board, all of which serve a particular purpose for a tailor.

5 Claims, 5 Drawing Figures

74
72
62
52
70
64
-50-
-60-
58
66
68
54
56
24
42
-40-
48
44
-12-
38
30
46
14
28
-26-
36
22
34
-18-
-10-
16
84
32
20
86
-80-
88
82
85

IRONING TABLE

BACKGROUND OF THE INVENTION

Clothes prepared wih sewn seams must be pressed to open the seam after sewing. In the preparation of clothes such as jackets, shirts, trousers, etc., seams are frequently formed in locations which are difficult to press with an iron and the iron-working surface of a conventional ironing table. Accordingly, a need exists for access to a plurality of iron-working surfaces which are particularly suited for supporting or exposing the seemingly inaccessable seams to enable one to press these seams open.

It is also desirable to have a compact ironing table with a variety of iron-working surfaces since any one of these specialty surfaces may be used too infrequently to justify a permanent table, particularly when the table is to be used in a household.

A variety of compact ironing tables have been suggested in the prior art. Harksen, U.S. Pat. No. 507,221 suggests a table with a removable top and a base, both having iron-working surfaces. This table lacks stability and the desired versitility for use by a tailor. U.S. Pat. Nos. 152,296 and 265,646 suggest portable tables or ironing boards which can be mounted on table tops and the like to provide ironing surfaces.

BRIEF STATEMENT OF THE INVENTION

This invention provides a very compact and stable ironing table which has a plurality of interchangeable iron-working surfaces that are of a size and shape for particular ironing tasks. The iron-working surfaces are the upper or exposed surfaces of a plurality of elongated members that can be quickly and securely mounted onto an upright standard of an ironing table base without any significant mechanical dexterity. These elongated members are secured to the upright standard by first clamping means at the rear of the table which comprises dowel means carried by the base with a cooperative eyelet means carried at the rear undersurface of the elongated member, and second clamping means at a mid-portion of the table which comprises key means carried by the base with a cooperative keyway means carried on the undersurface of the elongated member. By this construction, a very simple interlocking of the members to the base is provided since each clamping means locks its associated elongated member to the base and restrains against any lateral, longitudinal or twisting movement.

BRIEF DESCRIPTION OF THE DRAWINGS

The invention is shown by the drawings of which.

DESCRIPTION OF THE PREFERRED EMBODIMENTS

Figures 1, 2, 3, 4, 5:
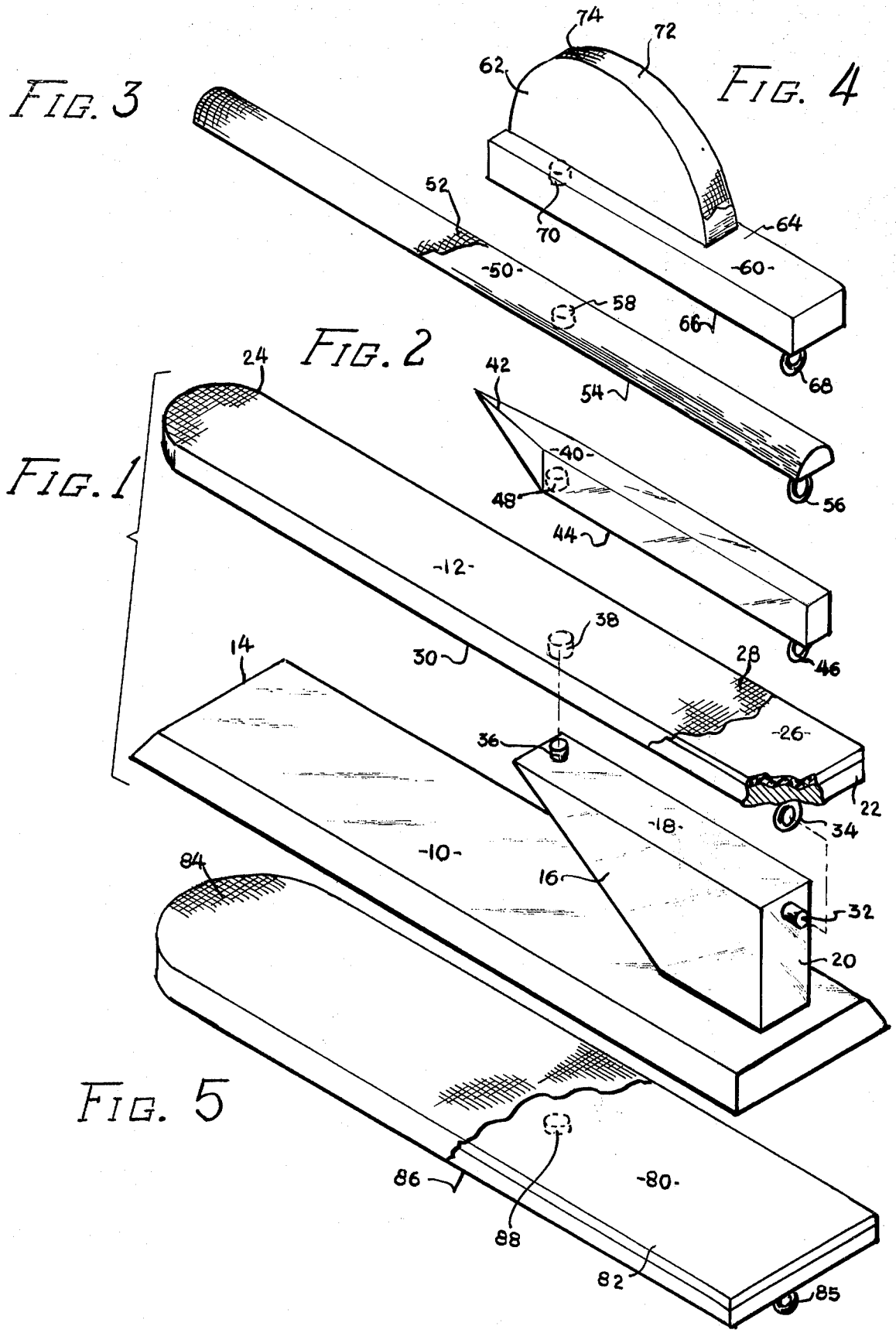
FIG. 1 is a view of the base and one of the removable elongated members.
FIGS. 2–5 are views of other elongated members which are included in the preferred embodiment of the invention.

Referring now to FIG. 1, the invention is shown as comprising the combination of a base 10 and a removable elongated member 12. The base is formed with a platform 14 which has a flat undersurface for resting on a table or similar supporting surface. The platform should be shaped as shown with a major dimension that extends beneath the elongated member mounted thereon to achieve a stable support for the table. Minor changes in the exact shape of the platform can of course be made without departing from the scope of the invention.

At one end of the platform 14 is mounted an upright standard 16 which has an upper, substantially flat, planar surface 18 and an outboard edge surface 20. These surfaces comprise the supporting and interlocking surfaces for the removable elongated members such as 12.

One of the elongated members 12 is formed from a flat, narrow board 22 which is approximately 24 inches long and about 3 to 4 inches wide. Preferably the board has a rounded free end 24. This member is a small sleeve board and is particularly useful when pressing sleeves and trouser legs. The board 22 has its iron-working surface covered with a layer of a soft material such as a plastic foam and a layer 28 of a strong fabric such as muslin or any other covering which is commonly employed on ironing surfaces. If desired, cover 28 can be secured to the board with a tie cord which passes through a peripheral loop about the cover in the manner commonly used for ironing board covers, or the cover can be glued or stapled to the cover.

The elongated member 12 has, as do all the interchangeable members of the invention, a substantially flat, planar undersurface 30 for resting on the upper surface 18 of base standard 16. The standard and undersurface 30 also bear first and second clamping means to interlock the elongated members securely in a cantilevered position on the standard. The first clamping means comprises dowel means 32 carried on the outboard edge 20 of standard 16 with a cooperating eyelet means 34 carried on the undersurface 30 of member 12. The second clamping means comprises key means, which can be in the form of second dowel means 36 carried at the inboard end of the standard 16 and on its upper surface 18. Cooperative keyway means, which can be in the form of aperture 38, can be carried at an intermediate position on the undersurface 30 of member 12 to engage second dowel means 36 when the member 12 is placed on standard 16.

The aforedescribed first and second clamping means impart a high degree of stability to the assembly. The first clamping means prevents all lateral shifting of the rear of member 12 and prevents forward, longitudinal movement of this member. The second clamping means prevents all longitudinal movement of member 12 and all lateral shifting of the forward end of member 12. The member 12 is prevented from twisting when side loads are placed on its upper surface by the opposed upper surface 18 of the standard 16 and undersurface 30 of the member 12 which are restrained from separating by the interlocking clamping means.

The clamping means, however, are not complex or demanding of a high level of physical dexterity. The member 12 can be placed on standard 16 simply by lowering the end bearing the eyelet means 34 onto the standard 16 and sliding it forward to draw eyelet means 34 over dowel means 32. The fore end of member 12 can then be released to rest the member 12 fully on standard 16 while centering the member so that dowel means 36 seats in aperture 38. The member 12 can not be removed from the assembly unless its fore end is raised to unseat dowel means 36. The use of the table by pressing an iron against clothes on the iron-working surface of member 12 will only insure that the interlocking of the second clamping means (dowel 36 and aperture 38) can not be released.

FIG. 2 shows a point board member 40 which is useful in pressing bound button holes, seams in collar points and other tasks involving small spaces or tight corners. This member 40 is preferably uncovered and comprises a narrow board, approximately 13 to 17 inches long and 0.5 to 1.5 inches wide with a sharply pointed end 42 having a taper of from 2° to about 20° from each side and from its undersurface. The member 40 also has a substantially flat, planar undersurface 44 with eyelet means 46 and keyway means (aperture) 48 positioned similarly to the same elements on member 12.

FIG. 3 illustrates a seam board member 50 which is particularly useful in pressing seams open in sleeves or trousers. This member is formed with an upper arcuate surface with a semicircular cross section perpendicular to its longitudinal axis. Typically the member is from 20 to 28 inches long and about 1 to 2 inches in width at its undersurface. The arcuate iron-working surface is preferably covered with a layer 52 of felt or similar fabric. The member has a substantially flat, planar undersurface 54 with eyelet means 56 and keyway means (aperture) 58 positioned similarly to the same elements on members 12 and 40.

FIG. 4 illustrates a half circle member 60 which comprises a semi-circular, upright plate 62 carried with its semi-circular cross section along the longitudinal axis of a base 64. The base 64 has substantially flat, planar undersurface 66, eyelet 68 and keyway means (aperture) 70 positioned similarly to the same elements on the other elongated members. The half circle member is particularly suited for pressing open seams in the arm's eye of shirts and jackets and in pressing open seams in collars. The arcuate surface 72 of member 60 is preferably covered with a layer 74 of felt or similar fabric.

FIG. 5 illustrates a second sleeve board member 80 which is larger than member 12 but which has the same general shape and contour of member 12. Typically this member is from 20 to 28 inches long and from 4 to 7 inches wide. Its iron working surface is also preferably covered with a layer 82 of plastic foam or similar material and a layer 84 of muslin or similar fabric in the manner described for member 12. The undersurface 86 of this member is substantially flat and planar and bears eyelet 85 and keyway means (aperture) 88 positioned similarly to the positions of the same elements on the other elongated members.

What is claimed is:

1. An iron table assembly comprising:

a. a platform;

b. an upright standard mounted to one end thereon with a substantially flat, planar upper surface and an outboard edge surface;

c. at least one elongated member having a substantially flat, planar undersurface for opposed resting on the upper surface of said standard and an upper iron-working surface;

d. first clamping means to interlock said member to said standard comprising dowel means carried on the upper end of said outboard edge surface of said standard and cooperative eyelet means carried at one end of said elongated member on the undersurface thereof to be slipped over the free end of said dowel means and thereby engage said dowel means when said elongated member is placed with its undersurface resting on the upper surface of said standard; and e. second clamping means to interlock said member to said standard comprising key means carried at the inboard end and on said upper surface of said standard and cooperative keyway means carried at an intermediate position on the undersurface of said elongated member to engage said key means when said elongated member is placed with its undersurface resting on the upper surface of said standard.

2. The ironing table assembly of claim 1 including a plurality of interchangeable elongated members having differently sized and shaped iron-working surfaces.

3. The ironing table assembly of claim 2 wherein one of said members comprises a narrow board having a width of from 0.5 to about 1.5 inches and a length from 13 to about 17 inches with a sharply pointed end having a taper of from 2° to about 20° from each side and its undersurface.

4. The ironing table assembly of claim 3 wherein one of said members comprises a narrow board having a semi-circular cross section perpendicular to its longitudinal axis.

5. The ironing table assembly of claim 4 wherein one of said members comprises a half round member having a semi-circular cross section along its longitudinal axis.

* * * * *